US006298844B1

(12) United States Patent
Skinkiss

(10) Patent No.: US 6,298,844 B1
(45) Date of Patent: Oct. 9, 2001

(54) FIREPLACE DRAFT SEAL

(76) Inventor: Sharon B. Skinkiss, 6300 N. Nickel Plate Ave., Louisville, OH (US) 44641

( * ) Notice: Subject to any disclaimer, the term of this patent is extended or adjusted under 35 U.S.C. 154(b) by 813 days.

(21) Appl. No.: 08/694,200

(22) Filed: Aug. 8, 1996

Related U.S. Application Data

(60) Provisional application No. 60/002,075, filed on Aug. 9, 1995.

(51) Int. Cl.[7] ..... F24B 1/92
(52) U.S. Cl. ..... 126/545; 126/547; 126/500
(58) Field of Search ..... 126/500, 544, 126/545, 547

(56) References Cited

U.S. PATENT DOCUMENTS

| | | | | |
|---|---|---|---|---|
| 1,830,364 | * | 11/1931 | Knudson | 126/547 |
| 3,789,825 | * | 2/1974 | Reiner | 126/545 |
| 3,888,232 | * | 6/1975 | Le Brun | 126/547 |
| 4,072,140 | * | 2/1978 | Gallagher | 126/546 |
| 4,160,442 | * | 7/1979 | Fox et al. | 126/547 |

* cited by examiner

*Primary Examiner*—Ira S. Lazarus
(74) *Attorney, Agent, or Firm*—Ralph J. Skinkiss

(57) ABSTRACT

The herein taught invention generally relates to domestic fireplaces particularly of the wood burning type and a method of, and apparatus for sealing such fireplaces to prevent the loss of conditioned air (heated and/or cooled) from the living quarters through such fireplaces.

7 Claims, 3 Drawing Sheets

FIREPLACE DRAFT SEAL

RELATED APPLICATION

This application is a continuation of my presently pending provisional application Ser. No. 60/002,075, filed on Aug. 9, 1995.

BACKGROUND OF THE INVENTION

The herein taught invention generally relates to domestic fireplaces particularly of the wood burning type and a method of, and apparatus for sealing such fireplaces to prevent the loss of conditioned air (heated and/or cooled) from the living quarters through such fireplaces.

It is known that for a fireplace to function properly the fireplace must necessarily be designed to create a naturally inherent draft whereby air is drawn into the fire box, upward through the chimney and expelled into the atmosphere outside the premises. Such draft air is drawn from the room within which the fireplace is situated. Thus the natural draft of the typical domestic fireplace acts as an air pump continually withdrawing conditioned air from the room, and the premises as a whole, wherein the fireplace is located.

Although the typical domestic fireplace may be provided with a chimney damper, which generally acts to close-off the flue and/or chimney, the dampers, by reason of the large dimensional tolerances necessary to permit operation over a wide temperature range causes inherent and significant air leaks when the damper mechanism has cooled to room temperatures.

Thus because of the inherent structure of the typical domestic fireplace damper mechanisms an open path through the fireplace whereby conditioned room air may pass always exists. Therefore, because of the naturally occurring continuous draft created by the fireplace, conditioned room air is continuously withdrawn from the room. Because of the continuous withdraw of conditioned air (heated or cooled) from the premises unnecessary expense is expended to replace the withdrawn conditioned.

The herein disclosed invention provides a simple solution for preventing the naturally occurring loss of conditioned room air, as described above, and employs the fireplace's natural draft in the process.

BRIEF DESCRIPTION OF THE INVENTION

I have discovered that by placing a thin sheet of plastic material over the fireplace opening the natural draft of the fireplace immediately draws the sheet of plastic tight against any structure spanning the fireplace opening such as glass doors or the typical fire screen. The pressure of the atmosphere acting against the sheet, forces the thin plastic sheet sealingly into, or up against, any and all openings wherethrough air may be drawn and exit through the chimney.

Although the action of atmospheric pressure against the plastic sheet is, of itself, sufficient to keep the sheet in place without any fastening means I have discovered that any fireplace will, because of outside wind gusts, experience an occasional down draft some of which may be sufficient to dislodge the sheet from the fireplace structure.

To prevent the occasional dislodging of the sheet from the fireplace structure, I have found that by merely securing the two top corners of the sheet to the fireplace structure the sheet will be retained in place until the upward draft reestablishes itself and the sheet will be drawn tight against the fireplace structure once again.

A simple "toothpick" like device or a piece of double adhesive tape has been found sufficient to retain the sheet in place during the occasional down draft. Also since the frame structure surrounding the fireplace opening within the room is typically made of ferrous metal a small magnet will also suffice to retain the plastic sheet in place during the occasional down draft.

If the sealing sheet were made of a heat resistant material, such as TEFLON or aluminum foil, the sheet may also be used to snuff out a fire in the fire box by starving the fire of the oxygen necessary to maintain combustion. Thus a simple and efficient means is provided to snuff out a fire prior to going to bed at night and/or otherwise leaving the premises.

DETAILED DESCRIPTION OF THE INVENTION

Figure 1:
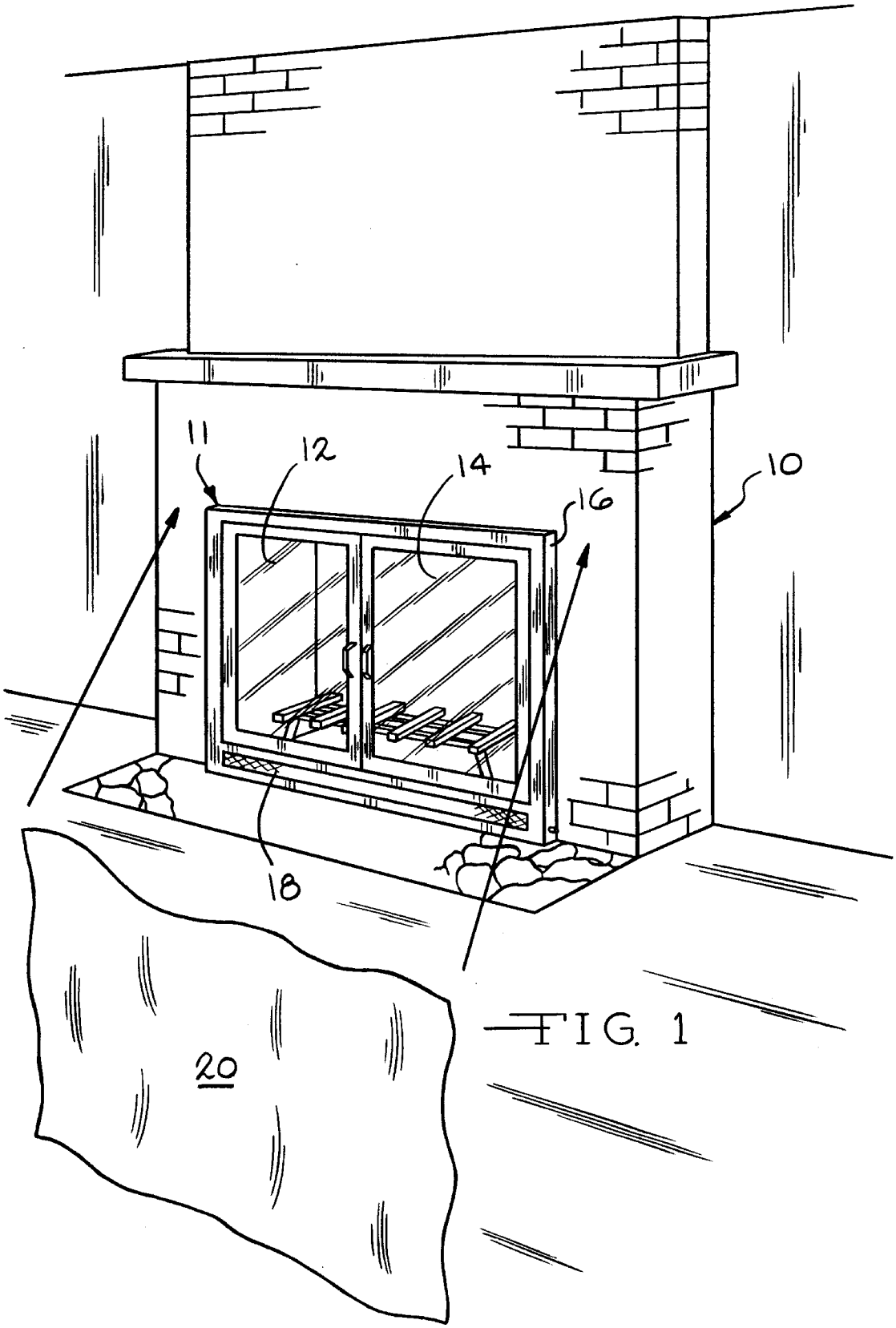
FIG. 1 is a pictorial view of a typical domestic fireplace suitable for application of my invention and showing the placement of my draft seal thereon.

FIG. 1 illustrates a typical brick domestic, wood burning, fireplace 10 having the fire box thereof enclosed by glass doors 12 and 14. Glass doors 12 and 14 are hingedly attached to frame 16 which is permanently attached to the brick structure of fireplace 10. Frame 16 is typically provided with a draft air vent 18 which may be open or closed for controlling the intensity of the fire in the fire box.

Figure 2:
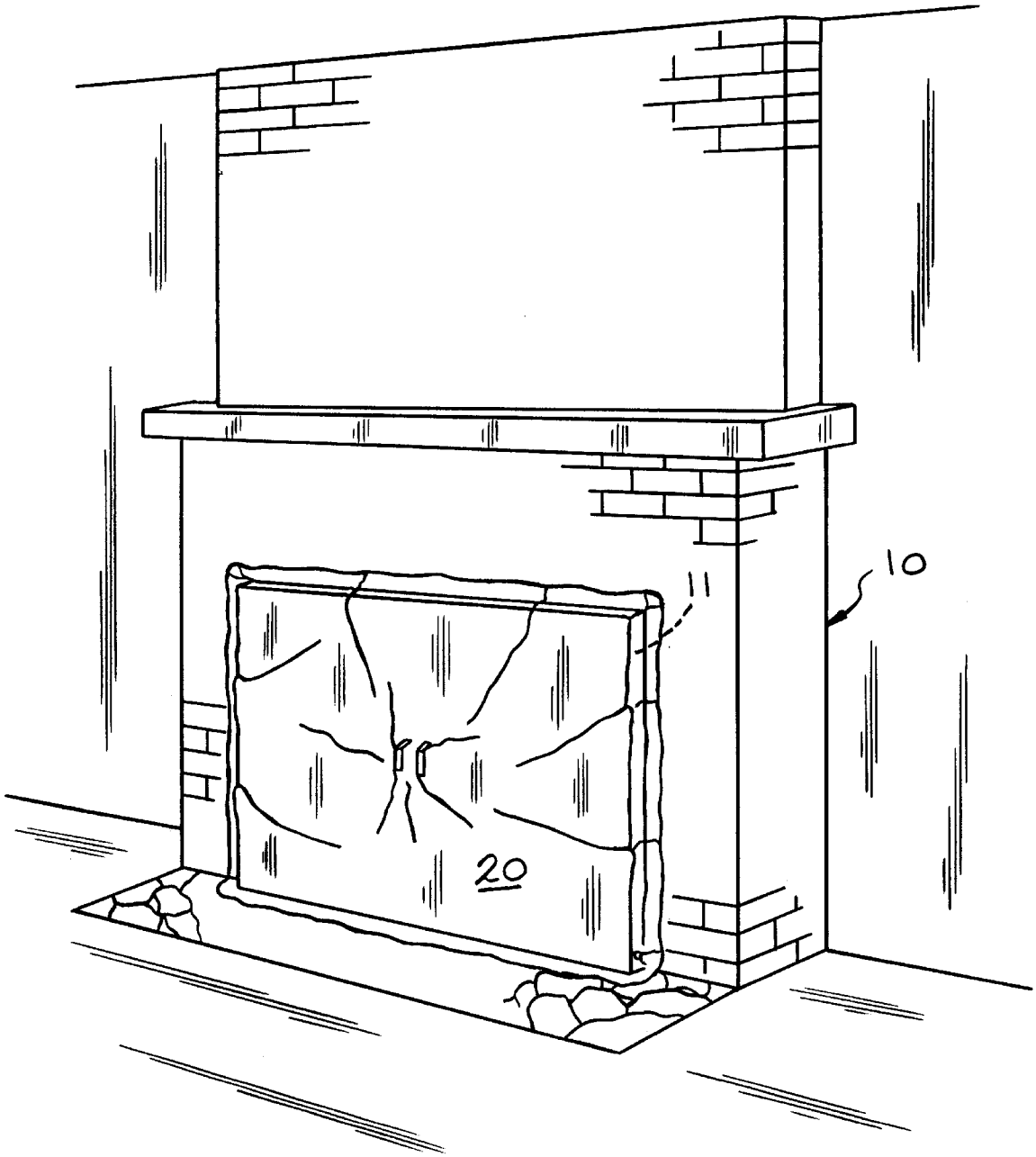
FIG. 2 is a pictorial view of the fireplace as shown in FIG. 1 with my draft seal in place.

To seal the fireplace opening (when not in use) thereby interrupting the flow of air that typically exits from the room, into the fire box, and through the chimney, by action of the constant natural draft therein, a thin pliable sheet of air impervious material 20, of sufficient size to cover the glass doors 12 and 14 and frame 16, is placed over the door assembly as illustrated by the arrows in FIG. 1. Because of the constant natural draft existing within all fireplaces, sheet 20 will be drawn against the door assembly 11, as illustrated in FIG. 2, and held in place by the differential pressure between the room (at atmospheric pressure) and the fire box (at a reduced static pressure because of the chimney draft) thereby effectively choking the flow of conditioned room air into and through the fireplace.

I have found that a sheet of common polyethylene plastic material having a thickness of less than one mil is suitable to practice the present invention; and that a sheet of plastic material of approximately 0.4 mils is most preferable in that 0.4 mil material is easily drawn into, and seal, the small crevices of the fireplace structure such as those that exist between the doors and the surrounding frame.

Although the differential pressure acting upon sheet 20 will generally retain sheet 20 in place, thereby effectively sealing the fireplace and preventing the passage of room air into the fire box and exiting through the chimney (not shown) testing has shown that there are occasions when, because of outside atmospheric conditions, an occasional and brief down draft will occur within the chimney and fire box sufficient to reverse the pressure differential across sheet 20 and at times may cause the release of sheet 20 from the door assembly 11.

Figure 3:
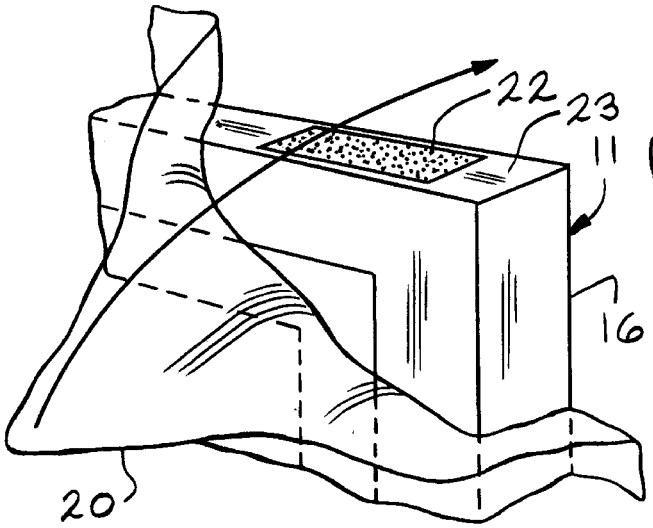
FIGS. 3 and 4 present a pictorial view of the upper right corner of the fireplace, as shown in FIG. 1, illustrating one method of securing my draft seal in place.
Figure 4:
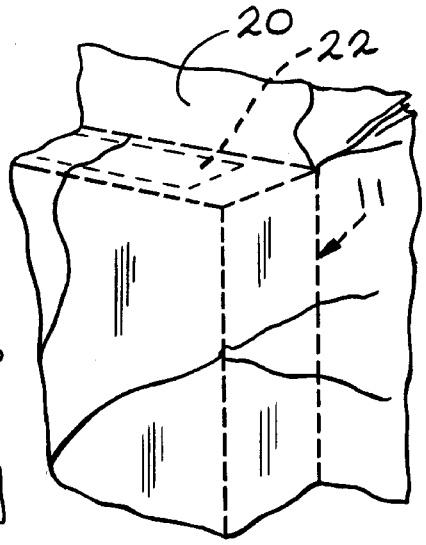

To prevent these occasional pressure differential reverses from dislodging sheet 20 from the door assembly 11, mechanical means may be employed so as to retain sheet 20 in place during the occasional pressure differential reversal. FIGS. 3 and 4 illustrate the placement of a small piece of double sided adhesive tape 22 upon the surface 23 of door frame 16 thereby affixing sheet 20 to frame 16. Short pieces of tape 22 may be placed at desired intervals around the full extent of frame 16.

Figure 5:
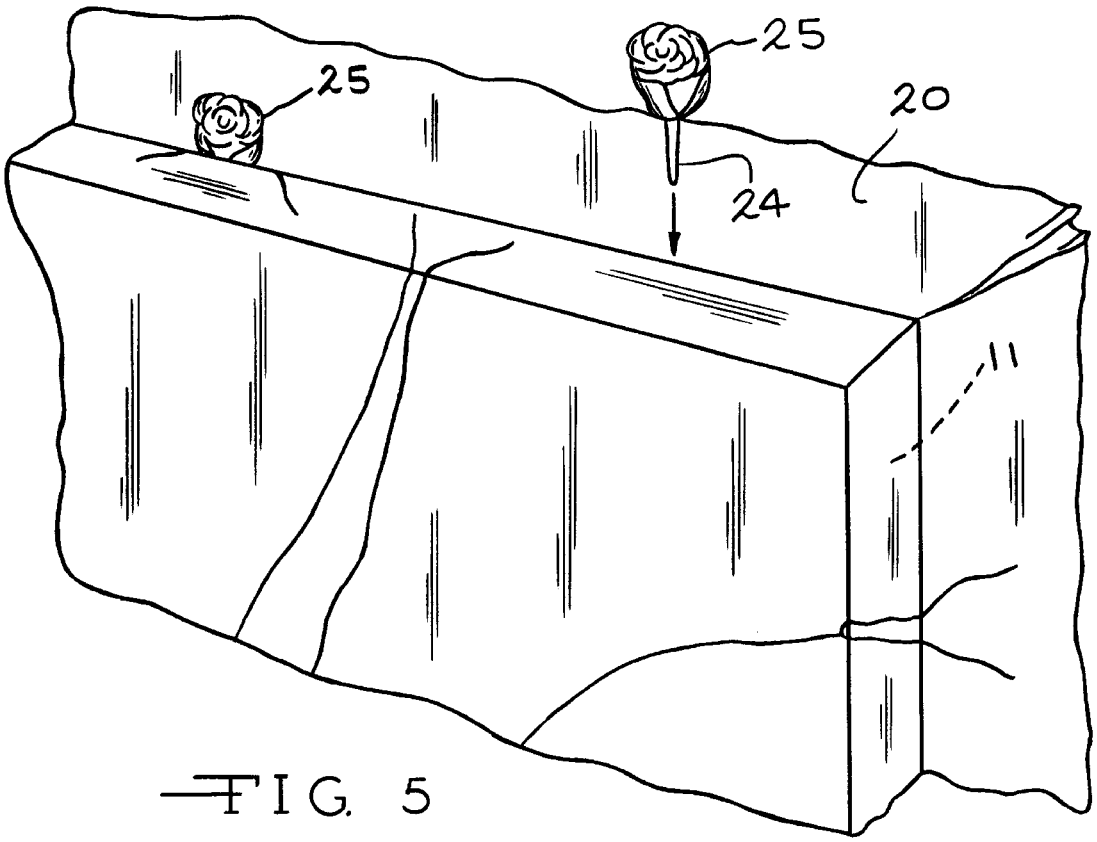
FIG. 5 presents a pictorial view of the upper right portion of the fireplace as shown in FIG. and illustrates an alternate method of securing my draft shield in place.

Alternatively a small peg 24 about the size of an ordinary tooth pick may be pressed through sheet 20 and into the small crevice existing between the fireplace brick structure and frame 16 thereby pinning sheet 20 to the door assembly. The top of the peg 24 may be stylishly configured, for example, as a rose 25 illustrated in FIG. 5 or any other desired figurine.

It has been my experience that two or three toothpick like pegs placed across the top and sides of frame 16 is sufficient to retain sheet 20 in place during the above described pressure differentials.

As a further means of preventing the release of sheet 20 from the fireplace structure during the occasional pressure differential reverse, a portion sheet 20 might be folded downward over the top of the doors such that when closed a film of material is in place over both the planar surfaces of the door. Thus when the normal draft is present in the chimney the portion of sheet of material on the room side of the doors acts to prevent air flow from the room and out through the chimney. Conversely, when the occasional down draft occurs, reversing the pressure differential, the sheet of material on the chimney side of the door acts to prevent the flow of air into the room from the chimney thereby preventing sheet 20 from becoming dislodged.

Although the invention as described above is taught as a domestic fireplace sealing device, the invention may be used any where it is desired to prevent the flow of air, or any other fluid, across a porous surface as caused by a pressure differential. Such another use of the present invention is to seal the typical entry door to a home basement thereby preventing the flow of cool conditioned air from the living quarters into the lower level basement.

In accordance with the provisions of the patent statutes, the principle and mode of operation of the invention have been illustrated and described in what is considered to represent its preferred embodiment. However, it should be understood that the invention can be practiced otherwise than as specifically illustrated and described herein without departing from its spirit or scope.

I claim:

1. A method of sealing the fire box of a fireplace wherein a natural draft of air flows into said fire box through a frontal opening and exits through an exhaust flue, and wherein said frontal opening includes structural means, extending across said frontal opening, that closes-off said frontal opening when said fireplace is in use, comprising the steps of:

a) providing a frameless, thin, sheet of air impermeable, pliable material, b) placing said sheet of material over said structural means when said fireplace is not in use thereby permitting the natural draft of air through said fire box to draw said sheet of material against said structural means thereby blocking the flow of air there through.

2. The method as claimed in claim 1 including the step of providing securement means to hold said sheet of material in place.

3. In a domestic fireplace having a fire box, exhaust means for the removal of smoke and combustion gases from said fire box and at least one frontal opening for the introduction of combustible material into said fire box and means for closing-off said frontal opening when said fire box is in use whereby a natural draft of air may flow into said fire box through said means for closing-off said frontal opening and exiting said fire box through said exhaust means, the improvement comprising sealing means for blocking the flow of draft air through said means for closing-off said frontal opening when said fireplace is not in use, said sealing means comprising a frameless thin sheet of air impermeable, pliable material positioned across said means for closing-off said frontal opening whereby said natural draft of air draws said sheet of material against said means for closing-off said frontal opening.

4. The improvement as claimed in claim 3 including securement means for securing said sheet of material in place.

5. The improvement as claimed in claim 3 wherein said means for closing-off said frontal opening comprises door means.

6. The improvement as claimed in claim 5 wherein said door means comprises folding glass doors.

7. The improvement as claimed in claim 3 wherein said means for closing-off said frontal opening comprises a spark arresting screen.

* * * * *

UNITED STATES PATENT AND TRADEMARK OFFICE

CERTIFICATE OF CORRECTION

PATENT NO. : 6,298,844 B1
DATED : October 9, 2001
INVENTOR(S) : Skinkiss

It is certified that error appears in the above-identified patent and that said Letters Patent is hereby corrected as shown below:

Title page,
Item [*], delete "813" and insert -- 677 --.

Signed and Sealed this

First Day of July, 2003

JAMES E. ROGAN
*Director of the United States Patent and Trademark Office*